US005960096A

United States Patent [19]

Imahori et al.

[11] Patent Number: 5,960,096

[45] Date of Patent: Sep. 28, 1999

[54] ELECTROACOUSTIC TRANSDUCER

[75] Inventors: Yoshio Imahori; Yoshiharu Oishi, both of Shizuoka, Japan

[73] Assignee: Star Micronics Co., Ltd., Shizuoka, Japan

[21] Appl. No.: 08/833,063

[22] Filed: Apr. 3, 1997

[30] Foreign Application Priority Data

Apr. 4, 1996 [JP] Japan ..... 8-108558

[51] Int. Cl.[6] ..... H04R 25/00

[52] U.S. Cl. ..... 381/417; 381/412; 381/396

[58] Field of Search ..... 381/396, 398, 381/417, 395, 412, 431, 386, 152, 160; 367/175

[56] References Cited

U.S. PATENT DOCUMENTS 5,467,323 11/1995 Sone ..... 381/398

5,581,623 12/1996 Ishimura et al. ..... 381/396

FOREIGN PATENT DOCUMENTS 7-117837 12/1995 Japan ..... G01K 9/13

7-117838 12/1995 Japan ..... G01K 9/13

*Primary Examiner*—Huyen Le

*Attorney, Agent, or Firm*—Sughrue, Mion, Zinn, Macpeak & Seas, PLLC

[57] ABSTRACT

An electroacoustic transducer, which has a case, a base located in the case, a core attached to the center of the base, a coil wound around the core, a magnet placed around the coil with a clearance formed in between with one end of the magnet is supported by the base, a support member located around the magnet for supporting an elastic plate, and a magnet support portion provided in the support member for supporting the other end of the magnet.

12 Claims, 11 Drawing Sheets

ELECTROACOUSTIC TRANSDUCER

BACKGROUND OF THE INVENTION

1. Field of the Invention

The present invention relates to an electroacoustic transducer, and, more particularly, to an electroacoustic transducer, which has a magnet support portion in a support member which supports a diaphragm comprising an elastic plate (also called a resonance plate) and an added mass attached to the center of said elastic plate, and hence, the magnet support portion supports the magnet between a base and the magnet support portion, thereby an unexpected detachment of the magnet from the base is prevented.

2. Description of the Related Art

A structure of an electroacoustic transducer as an example of the prior art is illustrated in FIGS. 11 and 12. There is a case 401, and formed at the center of the left-hand end portion in FIG. 12 is a sound port 403. The case 401 is provided with a support ring 405 at the inner wall of the right-hand portion in FIG. 12. There is an opening 407 formed in the right-hand end portion in FIG. 12. A base member 409 is secured to the opening 407. The base member 409 comprises a core 411 attached to the center thereof, and also a board 413 attached thereto.

A coil 415 is wound around the core 411. The respective terminals of the coil 415 are securely connected, by means of solder, for example, to lead terminals 417 and 419 attached to the board 413. A magnet 423 is placed around the coil 415 with an existence of a ring-like clearance 421 formed in between. The aforementioned support ring 405 is provided at the outer periphery of the magnet 423, having a step portion 425 at which a diaphragm 426 is supported. The diaphragm 426 comprises an elastic plate 427 and a magnetic piece 429 which are attached as an added mass to the center portion of the elastic plate 427.

In the thus constituted electroacoustic transducer, the elastic plate 427 integrally provided with the magnetic piece 429, is set to have a given polarity by means of the magnet 423, and hence, is attracted to the magnet 423. When a current flows across the coil 415 via the lead terminals 417 and 419 under this situation, the core 411 is magnetized, generating a magnetic field at the distal end thereof. When the magnetic pole of the core 411 induced by the coil 415 is different from the magnetic pole induced by the magnet 423 attached to the elastic plate 427, the elastic plate 427 is attracted to the core 411. When the magnetic pole of the core 411 induced by the coil 415 is the same as the magnetic pole induced by the magnet 423 attached to the elastic plate 427, the elastic plate 427 repels the core 411. Consequently, by allowing the current to intermittently flow in either direction, the elastic plate 427 repeats the above-discussed operation. In other words, the elastic plate 427 vibrates at a given frequency, thus generating a sound.

There is another type of electroacoustic transducer of which structure is shown in FIGS. 13 and 14. There is an upper case 501, and the upper case 501 has a base member 503 attached to the bottom thereof. A base 505 and a core 507 are integrally secured inside the upper case 501 (on the base member 503). The integrated material of the base 505 with the core 507 is called "pole piece". A coil 509 is wound around the core 507, and a support ring 511 is placed around the coil 509. A magnet 513 is provided on the inner wall of the support ring 511. A ring-like clearance 515 is formed between the magnet 513 and the coil 509.

Formed at the left-hand end portion of the support ring 511 in FIG. 14 is a step portion 517 at which a diaphragm 518 is provided. The diaphragm 518 comprises an elastic plate 519 and a magnetic piece 521 attached as an added mass to the center portion of the elastic plate 519. As seen in FIG. 13, lead terminals 523 and 525 have previously been implanted in an integral manner to the base member 503 by inserting. In the thus discussed structure, both coil terminals 509*a* and 509*b* of the coil 509 are respectively led out on the lead terminals 523 and 525, and are securely soldered to those lead terminals 523 and 525.

Since the action of the present type of electroacoustic transducer is the same as that of the electroacoustic transducer as discussed with reference to FIGS. 11 and 12, the description of such an action will not be repeated.

As regards the electroacoustic transducer according to the above discussed prior arts, there exists some problems as follows.

In the case of the electroacoustic transducer as illustrated in FIGS. 11 and 12, the magnet 423 is attracted to and fixed on the base member 409 by means of magnetic force, further the magnet 423 is adhered to and fixed on the base member 409 by means of adhesive. Such a type of electroacoustic transducer is mounted on a various type of electronic instruments, such as a portable telephone, etc., and when the electroacoustic transducer is mounted on the portable telephone, for example, the resistance against the drop shock at about 10,000 G-force is often required. However, when the above amount of shock is given to the conventional structural type of electroacoustic transducers, there is a possibility that the magnet 423 may peel off the base member 409. When the magnet 423 peels off the base member 409, the detached magnet 423 may be attracted to the elastic plate 427, otherwise may collide against the elastic plate 427, which results in deformation of the elastic plate 427, and hence, the desired acoustic performance is spoiled.

The magnet 423 peels off the base member 409 due to the following reasons. Namely, the magnet 423 is made of any metal of which specific gravity is greater, for example, samarium-cobalt, ferrite, iron-cobalt chromium, etc., in order to obtain a desired magnetic force. However, such metals are very hard in solidity, therefore the cutting is difficult, and instead, the grinding is usually performed at the finishing. As above discussed, the magnet 423 is made of metal of which finished surface is ground almost like a "mirror surface", the adherent strength by adhesive may not be sufficiently obtained, and hence, the desired adherent strength may not be obtained. Consequently, when any shock is given, the magnet 423 may peel off the base member 409.

There may be an adhesive available of which adherent strength is greater, but such an adhesive is usually very expensive, which leads to increase in costs.

There is a likewise problem in regard to the magnet 513 as illustrated in FIGS. 13 and 14.

The present disclosure relates to subject matter contained in Japanese Patent Publication Nos. 07-117837 and 07-117838, which are expressly incorporated herein by reference in their entireties.

SUMMARY OF THE INVENTION

It is an object of the present invention to provide an electroacoustic transducer, in which an unexpected detachment of magnet is prevented, thus the stable acoustic performance is obtained.

To achieve the object mentioned above, according to the present invention, there is provided an electroacoustic transducer, which has a case, a base located in the case, a core attached to the center of the base, a coil wound around the core, a magnet placed around the coil with a clearance formed in between with one end of the magnet supported by the base, a support member located around the magnet for supporting an elastic plate, and a magnet support portion provided in the support member for supporting the other end of the magnet.

With this structure, in the case of electroacoustic transducer in the present invention, there is provided a magnet support portion in the support member around the magnet which supports the elastic plate, so that the magnet is mechanically supported, by the magnet support portion, between the magnet support portion and the base.

Preferably, the support member of the electroacoustic transducer may be a support ring, which is placed on an inner peripheral side of the case, and which has a flange on an inner peripheral side of the support ring, thus the flange serves as said magnet support portion.

Preferably, the support member may be a case, which is placed on an outer peripheral side of the magnet, and which has a flange on an inner peripheral side of the case, thus the flange serves as the magnet support portion.

With this structure, the support member may be applied to a various type of electroacoustic transducers provided with a support ring, or with a portion serving as the support ring integrally formed with the case, etc.

Preferably, the surface of the flange facing the elastic plate may be slanted, and a clearance between the surface and the elastic plate increases towards the center of the elastic plate.

The flange as the magnet support portion may be formed protrusively on the support member with a clearance formed between the elastic plate and the flange.

Alternatively, the flange as the magnet support portion may be formed protrusively on the support member with no clearance formed between the elastic plate and the flange.

The flange as said magnet support portion may be provided continuously in a circumferential direction of the support member.

Alternatively, the flange as the magnet support portion may be provided intermittently in a circumferential direction of the support member.

Preferably, the electroacoustic transducer may be an electromagnetic type.

With this arrangement, since the magnet is mechanically supported between the base and the flange, the detachment of the magnet from the base is surely prevented. Consequently, when mounted on a portable telephone, for example, if any shock is given, the detachment of the magnet from the base is surely prevented, and hence, a deformation of the elastic plate due to detachment of, or collision against, the magnet, and further a fluctuation or a loss of acoustic performance thereof due to such a detachment, are surely prevented.

Further, it is not necessary to depend heavily on adhesives for adhering or fixing, thus the expensive adhesives are no longer required. Consequently, the scope of choice of adhesives becomes wider, which facilitates an adherent processing itself.

In the case that the surface of flange as a magnet support portion facing to the elastic plate is slanted so that the amount of clearance between the elastic plate and the flange is designed to increase gradually towards the center of the elastic plate, an interference of the elastic plate with the flange during vibration is surely prevented.

Further, in the case that the flange as the magnet support portion is protrusively formed on the support ring with a clearance formed between the elastic plate and the flange, the greater effect for preventing interference may be obtained.

BRIEF DESCRIPTION OF THE DRAWINGS

The invention will be described below in detail with reference to the accompanying drawings, in which.

DETAILED DESCRIPTION OF THE INVENTION

First Embodiment

Figure 1:
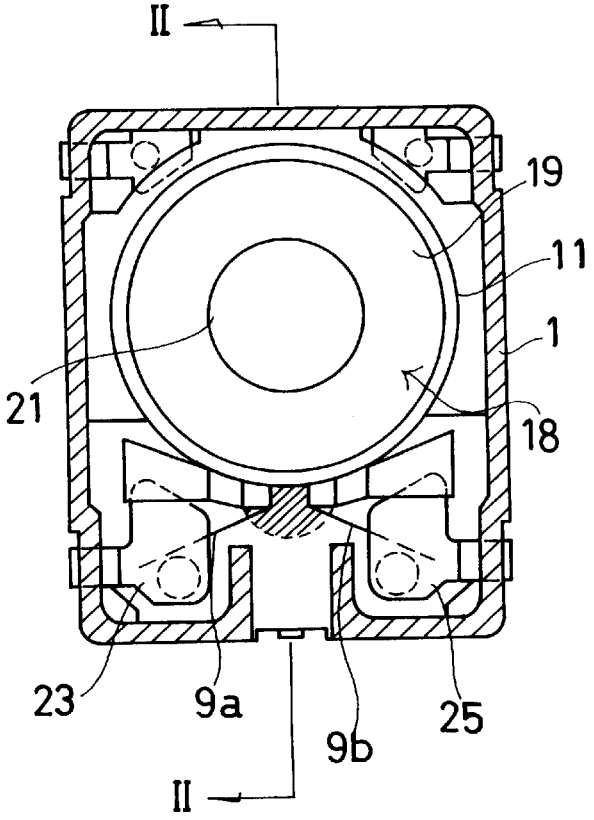
FIG. 1 is a plan view showing an internal structure of an electroacoustic transducer according to a first embodiment of the present invention by removing an upper surface of a case.
Figure 2:
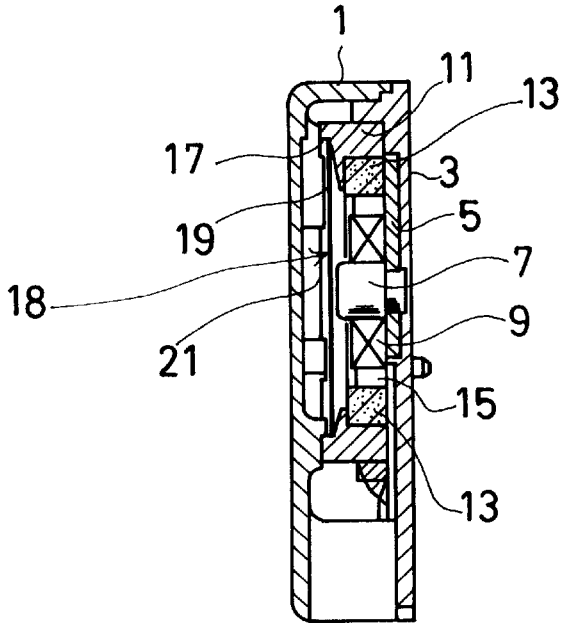
FIG. 2 is a cross-sectional view of the first embodiment taken along the line II—II in FIG. 1.

A first embodiment of the present invention will now be described with reference to FIGS. 1 and 2. As illustrated in FIGS. 1 and 2, there is an upper case 1, and the upper case 1 has a base member 3 attached to the bottom thereof. A base 5 and a core 7 are integrally secured inside the upper case 1 on the base member 3. The integrated material of the base 5 with the core 7 is called "pole piece". A coil 9 is wound around the core 7, and a support ring 11 is placed around the coil 9. A magnet 13 is provided on the inner wall of the support ring 11. A ring-like clearance 15 is formed between the magnet 13 and the coil 9.

Formed at the left-hand end portion of the support ring 11 in FIG. 2 is a step portion 17 at which a diaphragm 18 is provided. The diaphragm 18 comprises an elastic plate 19 and a magnetic piece 21 attached as an added mass to the center portion of the elastic plate 19. As seen in FIG. 1, lead terminals 23 and 25 have previously been implanted in an integral manner to the base member 3 by inserting. In the thus discussed structure, both coil terminals 9*a* and 9*b* of the coil 9 are respectively led out on the lead terminals 23 and 25, and are securely soldered to those lead terminals 23 and 25.

In the thus constituted electroacoustic transducer, the elastic plate 19 integrally provided with the magnetic piece 21, is set to have a given polarity by means of the magnet 13, and hence, is attracted to the magnet 13. When a current flows across the coil 9 via the lead terminals 23 and 25 under this situation, the core 7 is magnetized, generating a magnetic field at the distal end thereof. When the magnetic pole of the core 7 induced by the coil 9 is different from the magnetic pole induced by the magnet 13 attached to the elastic plate 19, the elastic plate 19 is attracted to the core 7. When the magnetic pole of the core 7 induced by the coil 9 is the same as the magnetic pole induced by the magnet 13 attached to the elastic plate 19, the elastic plate 19 repels the core 7. Consequently, by allowing the current to intermittently flow in either direction, the elastic plate 19 repeats the above-discussed operation. In other words, the elastic plate 19 vibrates at a given frequency, thus generating a sound.

Figure 3:
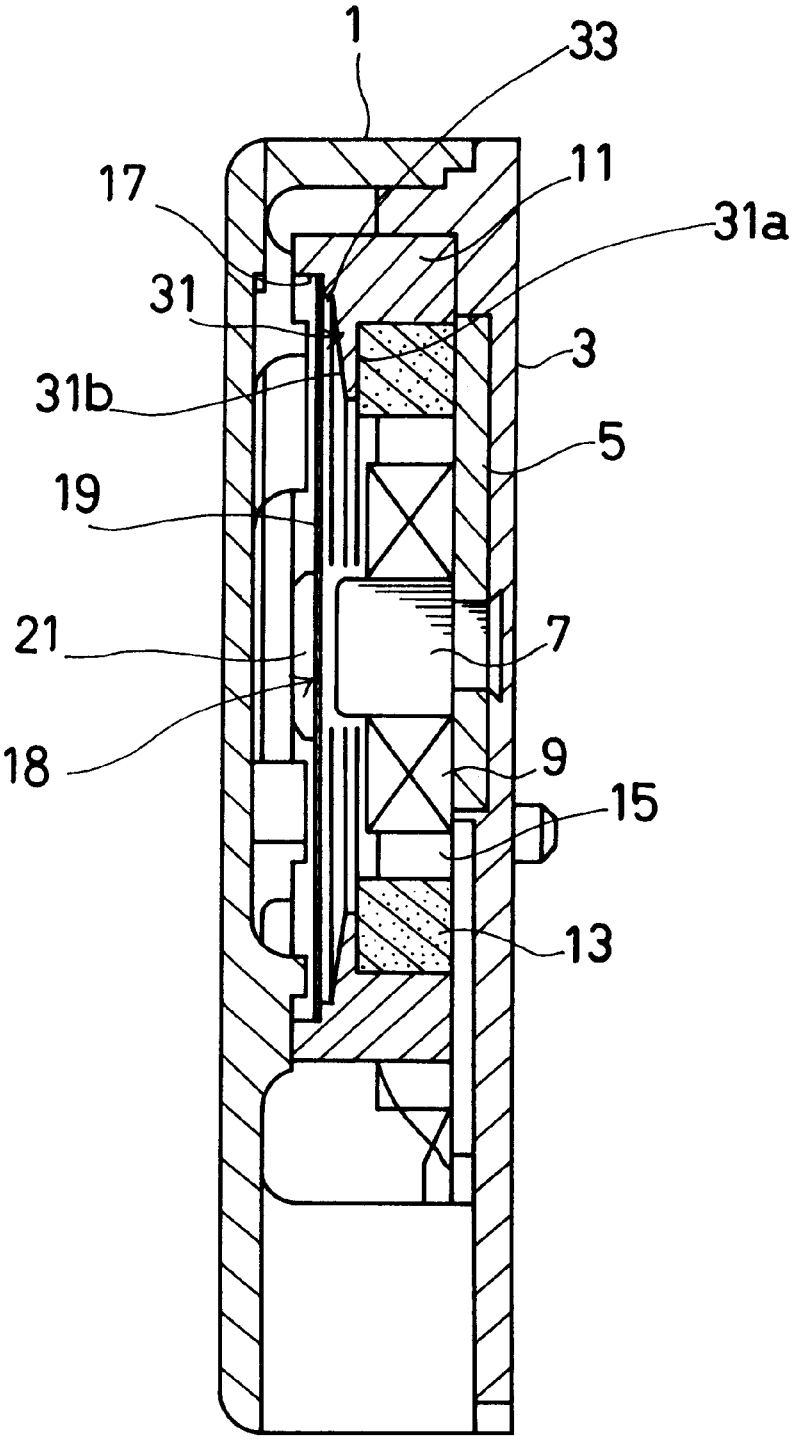
FIG. 3 is an enlarged cross-sectional view of the first embodiment shown in FIG. 2.

The structure of the support ring 11 will now be discussed specifically. As illustrated in FIG. 3, a flange 31 is protrusively provided in the support ring 11 of the present embodiment, and the flange 31 serves as a magnet support portion which supports the magnet 13. The flange 31 has a ring-like form, so that the magnet 13 is supported between the circumference of the flange 31 and the base 5. A clearance 33 is provided between the above-discussed step portion 17 and the protrusive flange 31. The flange 31 protrudes in such a form, that an end surface 31*a* on the side of the magnet 13 is a flat surface, and that another end surface 31*b* is a slant surface. The amount of clearance between the elastic plate 19 and the end surface 31*b* is designed to increase gradually towards the center of the elastic plate 19.

The present embodiment has the following advantages.

Firstly, since the magnet 13 is mechanically supported between the base 5 and the flange 31 of the support ring 11, the detachment of the magnet 13 from the base 5 is surely prevented. Consequently, when mounted on a portable telephone, for example, if any shock is given, the detachment of the magnet 13 from the base 5 is surely prevented, and hence, a deformation of the elastic plate 19 due to detachment of, or collision against, the magnet 13, and further a fluctuation or a loss of acoustic performance thereof due to such a detachment, are surely prevented.

Secondly, since the magnet 13 is mechanically supported between the base 5 and the flange 31, it is not necessary to depend heavily on adhesives for adhering or fixing, thus the expensive adhesives are no longer required. Consequently, the scope of choice of adhesives becomes wider, which facilitates an adherent processing itself.

As is understood per se, there is a structure in which adhering or fixing is performed without using the adhesive.

And thirdly, the flange 31 in the present embodiment comprises the end surface 31*b* as a slant surface, and the amount of clearance between the elastic plate 19 and the end surface 31*b* is designed to increase gradually towards the center of the elastic plate 19. Therefore, an interference of the elastic plate 19 with the flange 31 during vibration is surely prevented.

Further, since the clearance 33 is provided, prevention of interference of the elastic plate 19 with the flange 31 effectively improves.

Second Embodiment

Figure 4:
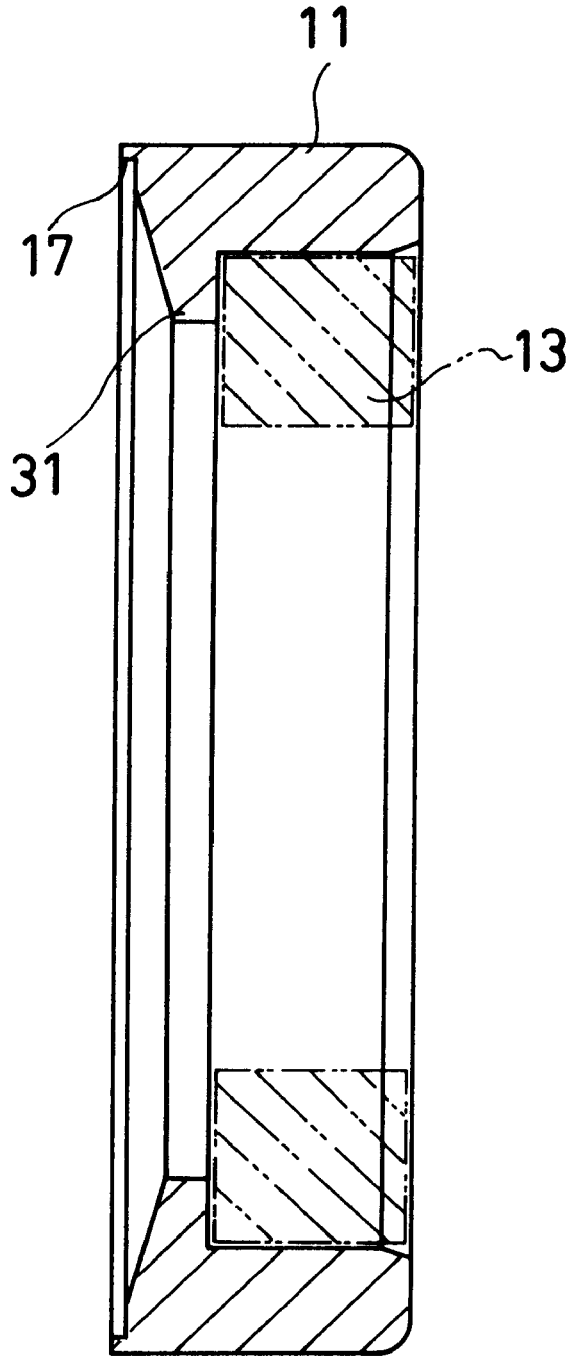
FIG. 4 is a cross-sectional view showing a relation between a support ring and a magnet according to a second embodiment of the present invention.

A second embodiment of the present invention will be described with reference to FIG. 4. FIG. 4 abstractly illustrates only the support ring 11 and the magnet 13 among the structure of the electroacoustic transducer. In the case of the first embodiment, the clearance 33 is provided between the protrusive flange 31 and the step portion 17 of the support ring 11. However, in the second embodiment, the inner periphery of the step portion 17 protrudes in order to serve as the flange 31, in which the clearance 33 (shown in FIG. 3) is not provided. Even in such a structure according to the second embodiment, the same effect as discussed in the first embodiment is substantially obtained.

Third Embodiment

Figure 6:
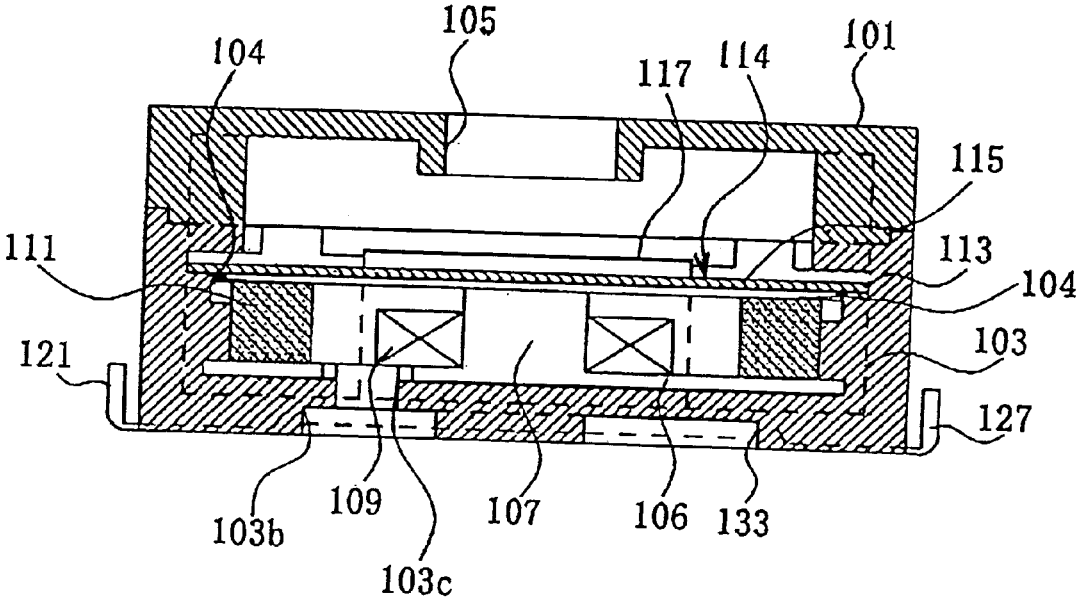
FIG. 6 is a cross-sectional view of the third embodiment taken along the line VI—VI in FIG. 5.
Figure 7:
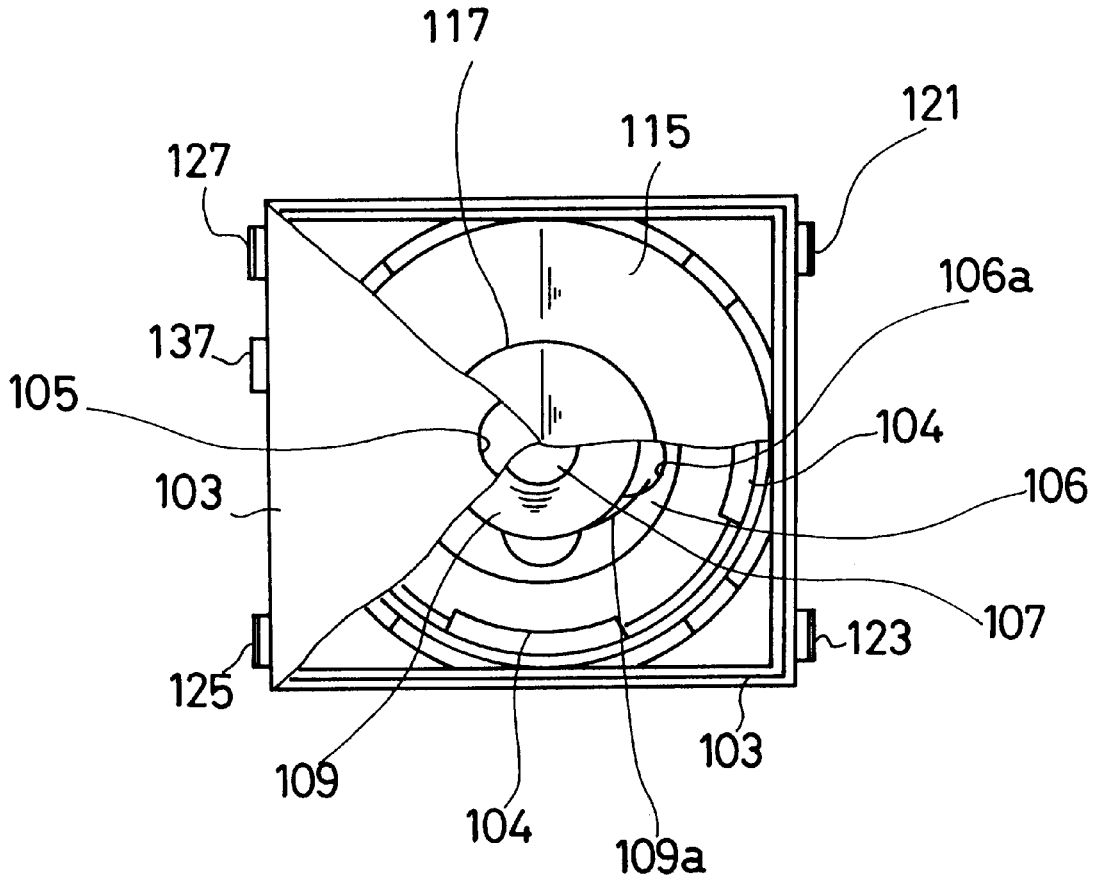
FIG. 7 is a plan view showing an elastic plate and a magnetic piece with a part of an upper case cut away, and showing a coil with parts of the elastic plate and the magnetic piece cut away, according to the third embodiment.
Figure 8:
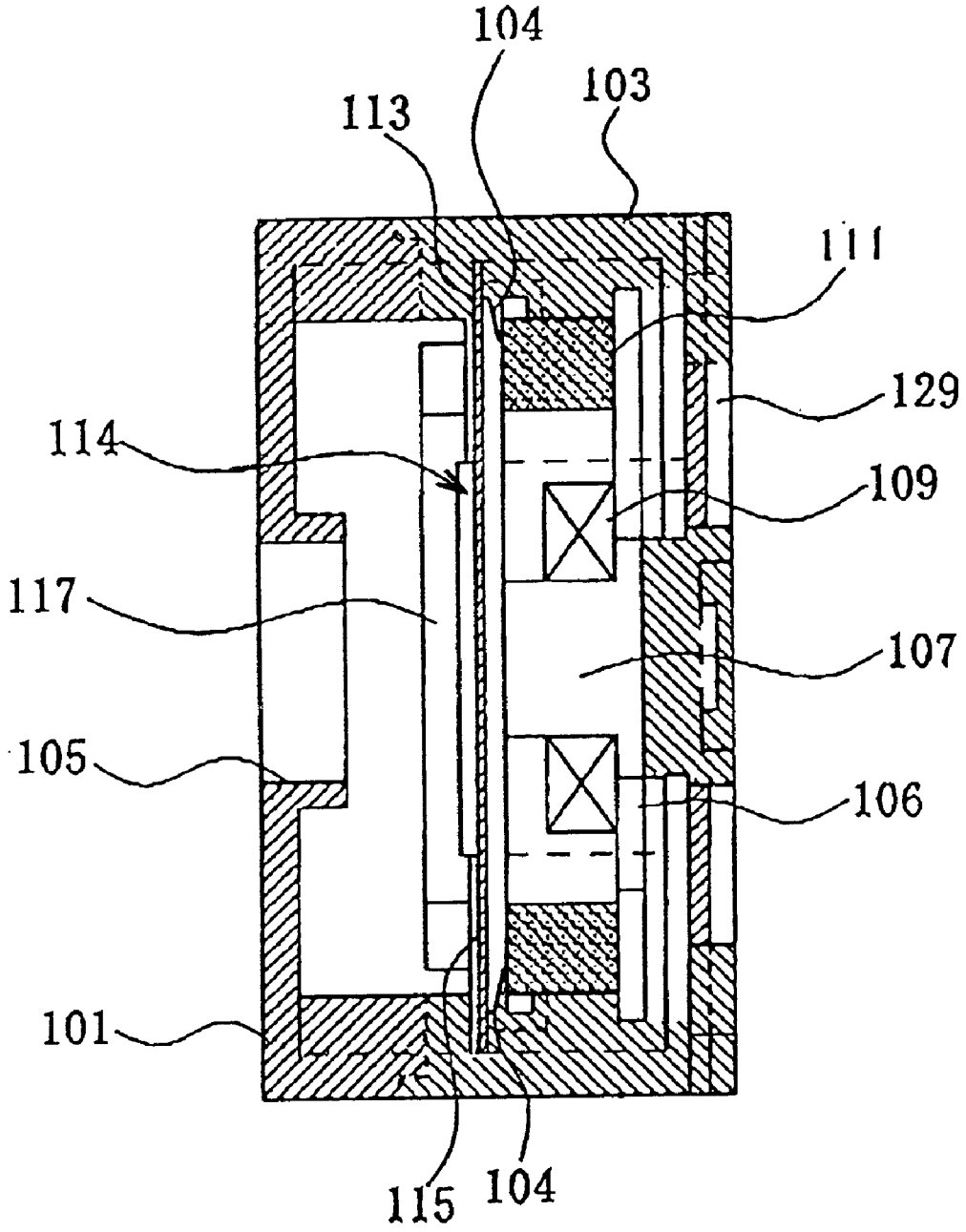
FIG. 8 is a cross-sectional view of the third embodiment taken along the line VIII—VIII in FIG. 5.

A third embodiment of the present invention will now be described with reference to FIGS. 5 through 10. As illustrated in FIGS. 6 and 8, there are an upper case 101 and a lower case 103, with a sound port 105 formed in the center of the top face of the upper case 101 in FIG. 6. A base 106 and a core 107 are arranged at the center portion in the lower case 103 in a securely integrated manner, and a coil 109 is wound around the core 107. A magnet 111 is placed around the coil 109 at the inner wall of the lower case 103. As shown in FIG. 7, the magnet 111 is supported at the outer periphery thereof by four support portions 104 (only two of which are shown in FIG. 7) protrusively provided on the inner wall of the lower case 103. Formed on the inner wall of the lower case 103 is a step portion 113 at which a diaphragm 114 is provided. The diaphragm 114 comprises an elastic plate 115 and a magnetic piece 117 attached as an added mass to the center portion of the elastic plate 115.

FIG. 7 is a plan view showing the elastic plate 115 and the magnetic piece 117 with a part of the upper case 101 cut away, and showing the coil 109 with parts of the elastic plate 115 and the magnetic piece 117 cut away.

Figure 5:
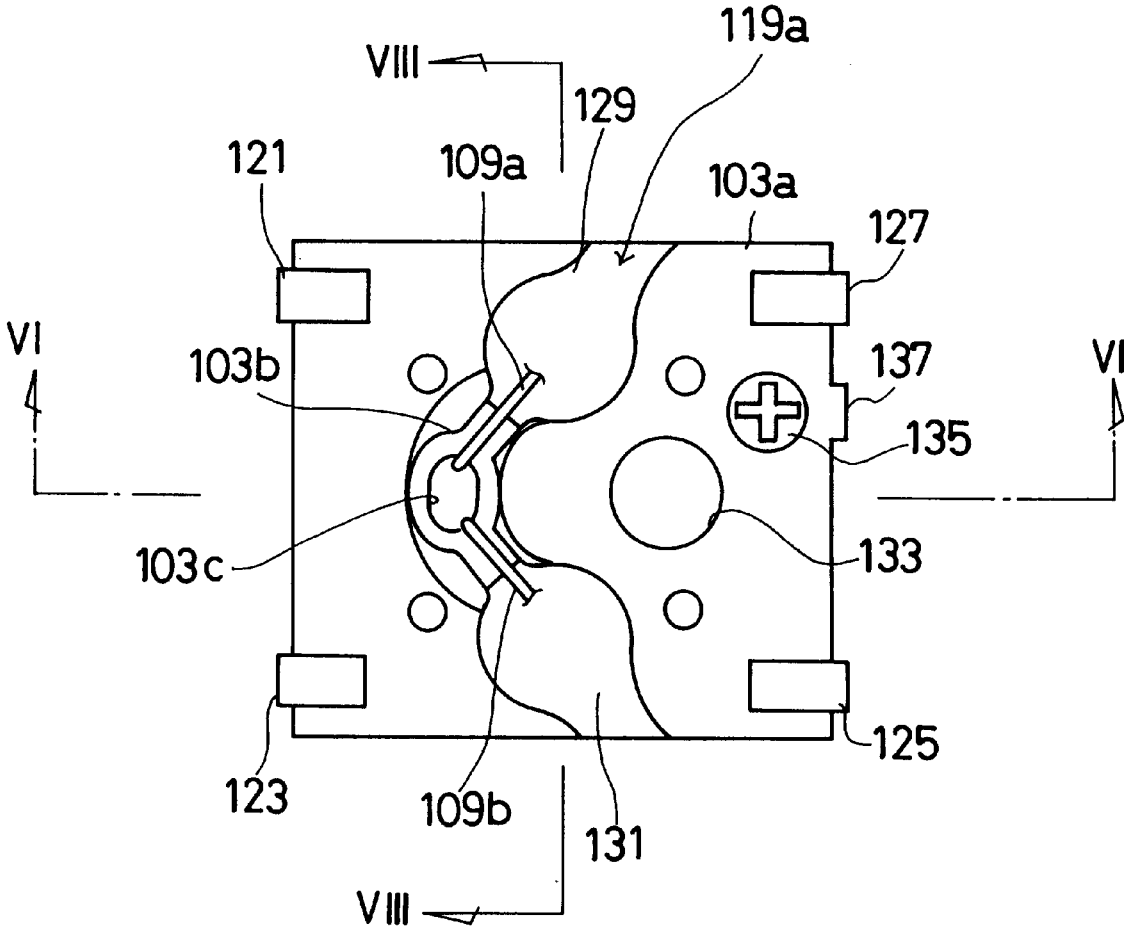
FIG. 5 is a plan view of an electroacoustic transducer according to a third embodiment of the present invention as viewed from the bottom side a lower case.

The lower case 103 has the bottom structure as shown in FIG. 5 as seen from the bottom side. The lower case 103 has a bottom wall 103*a* in which a groove 103*b* is formed. An opening 103*c* is formed in the center portion of the groove 103*b*.

An opening 106*a* is likewise formed in the base 106 located on the inner side of the bottom wall 103*a*, and the opening 103*c* is formed at the position matching with the opening 106*a*.

Figure 9:
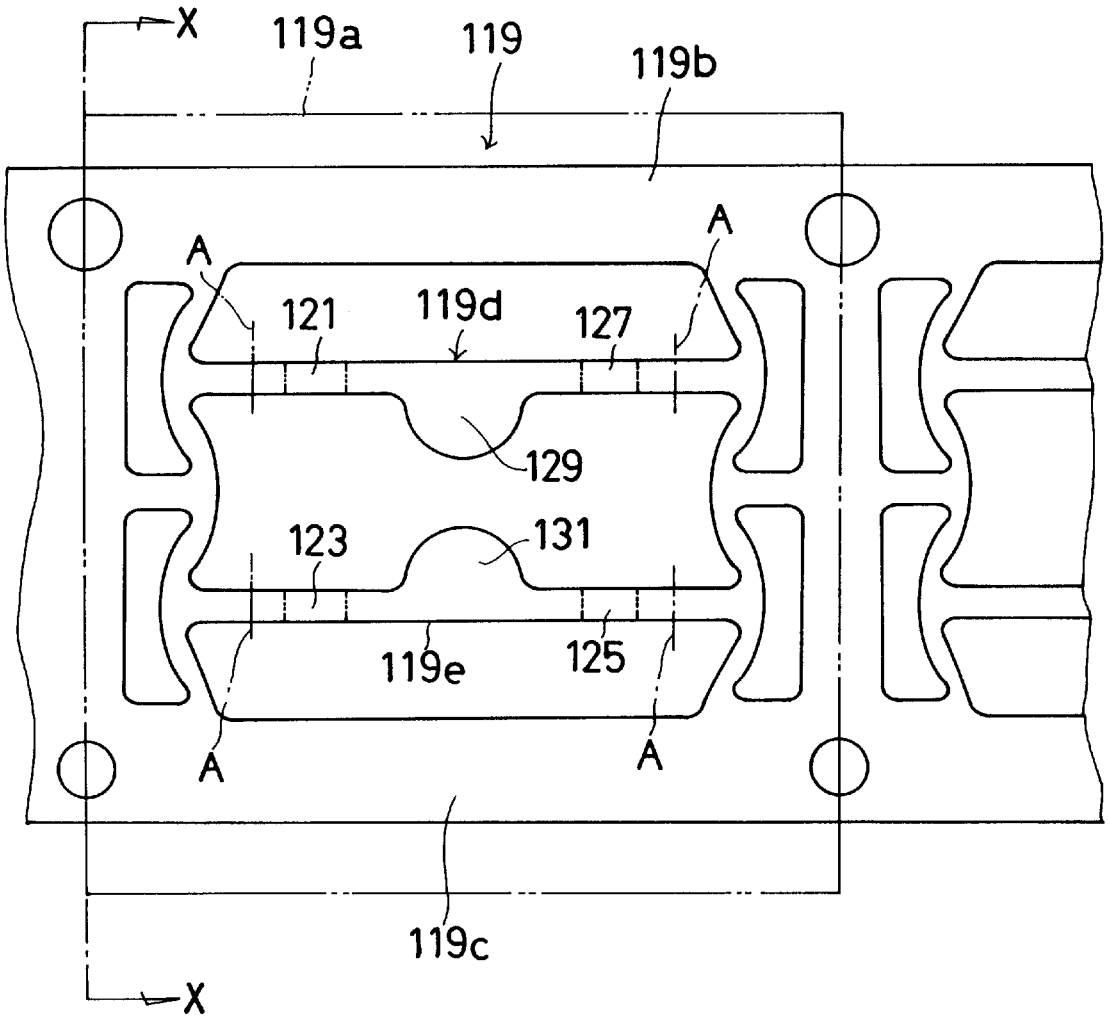
FIG. 9 is a plan view depicting a part of a lead frame according to the third embodiment.

The groove 103*b* obliquely extends nearly symmetrically in the up-and-down direction with the opening 103*c* at the center in FIG. 5. A part of a lead frame element 119*a* of a lead frame 119 shown in FIG. 9 is integrally buried in the bottom wall 103*a* by inserting. The four corner portions of the lead frame element 119*a* are exposed on the lower case 103 as external connection terminals 121, 123, 125 and 127. Some other parts of the lead frame element 119*a* are exposed in the groove 103*b* as lands 129 and 131.

Both coil terminals 109*a* and 109*b* of the coil 109 accommodated in the lower case 103 are led out to the outer side of the bottom wall 103*a* through the opening 106*a* of the base 106 and the opening 103*c* of the lower case 103. The coil terminals 109*a* and 109*b* are respectively placed along the lands 129 and 131, and securely soldered to the lands 129 and 131.

Figure 10:
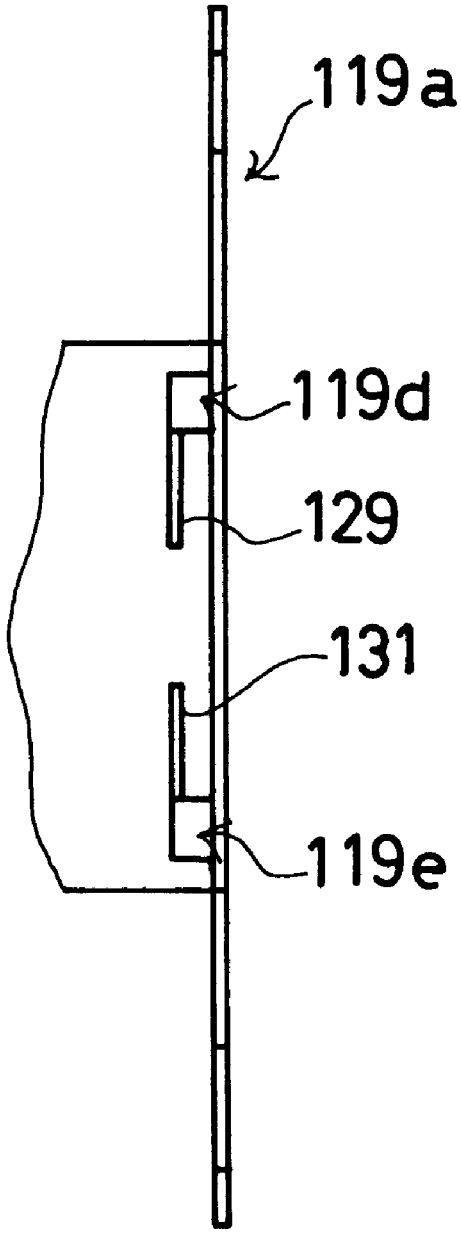
FIG. 10 is a cross-sectional view of the third embodiment taken along the line X—X in FIG. 9.
Figure 11:
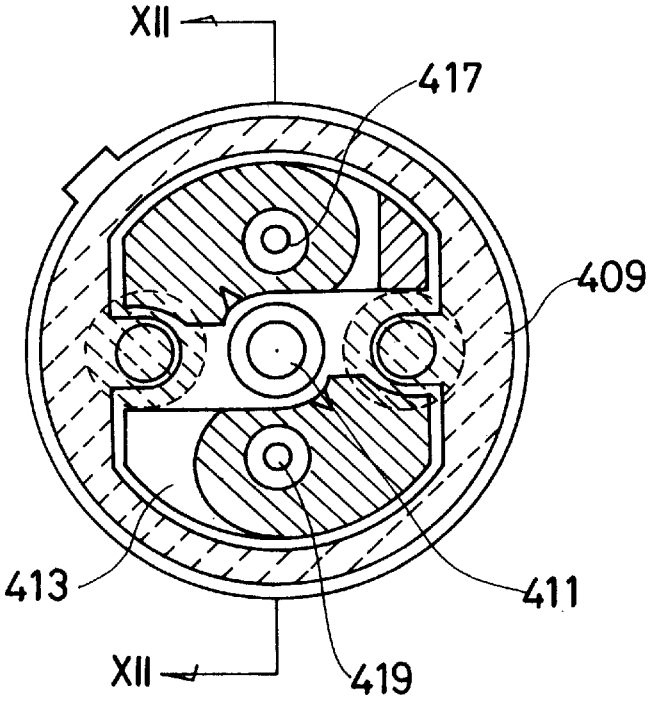
FIG. 11 (PRIOR ART)
FIG. 11 is a plan view of an electroacoustic transducer according to a prior art as viewed from the bottom side.
Figure 12:
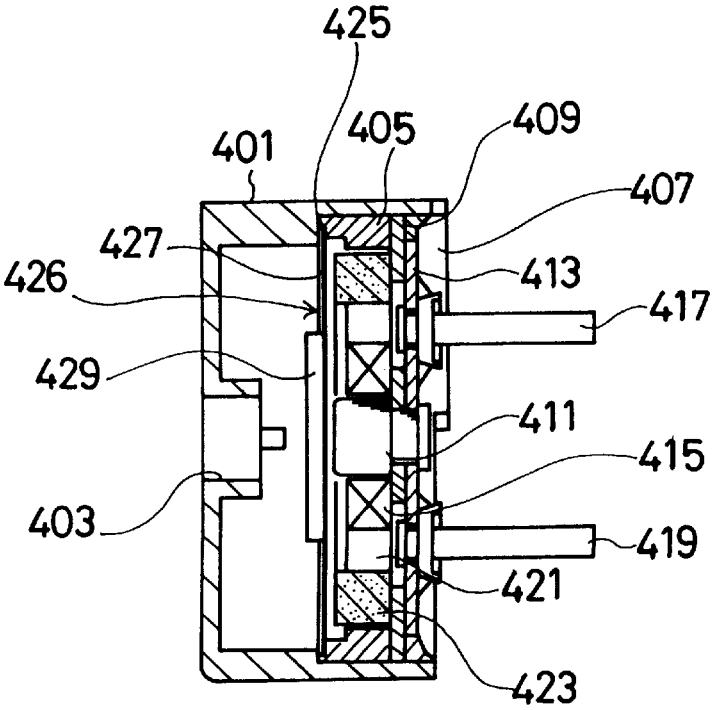
FIG. 12 (PRIOR ART)
FIG. 12 is a cross-sectional view of the prior art taken along the line XII—XII in FIG. 11.
Figure 13:
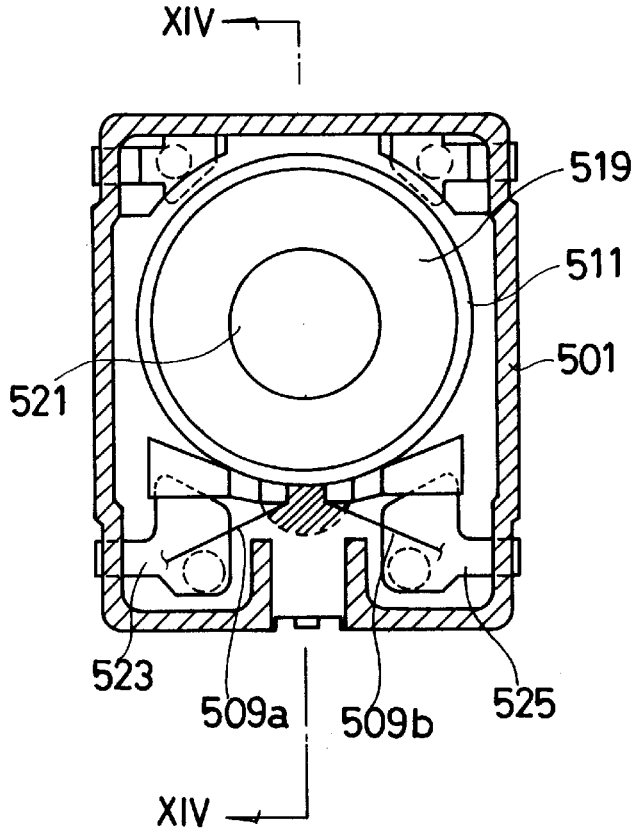
FIG. 13 (PRIOR ART)
FIG. 13 is a plan view of an electroacoustic transducer according to a prior art as viewed from the bottom side.
Figure 14:
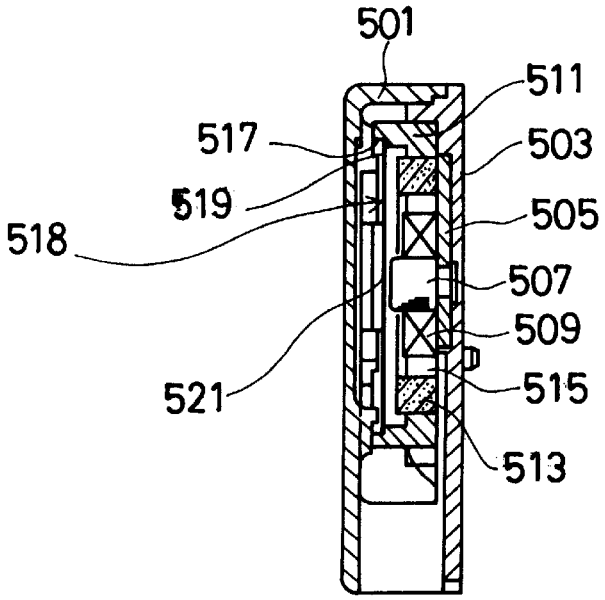
FIG. 14 (PRIOR ART)
FIG. 14 is a cross-sectional view of the prior art taken along the line XIV—XIV in FIG. 13.

The lead frame 119 will now be discussed specifically. The lead frame 119 has a shape as shown in FIGS. 9 and 10. The lead frame 119 has an arbitrary number of lead frame elements 119*a* (surrounded by a chain double-dashed line in FIG. 9) coupled side by side, each associated with a single electroacoustic transducer. The number of lead frame elements 119*a* serially connected is four, six, eight, or the like, for example, and the same number of electroacoustic transducers are to be manufactured at the same time. The lead frame elements 119*a* has wide portions 119*b* and 119*c* located at the top and the bottom in FIG. 9 and extending horizontally, and a pair of bridge portions 119*d* and 119*e* provided between the wide portions 119*b* and 119*c*. Portions which become the above-discussed external connection terminals 121, 123, 125 and 127, and portions which become the above-discussed lands 129 and 131, are provided on the bridge portions 119*d* and 119*e*.

With the thus constituted lead frame 119 placed along the mold (not shown), a resin is filled in the mold, yielding the lead frame 119 integrated with the lower case 103. This is the inserting method. Thereafter, the bridge portions 119*d* and 119*e* are cut along the cut lines A shown in FIG. 9, further the external connection terminals 121, 123, 125 and 127 are bent towards the upper case 101, providing the state shown in FIG. 5.

In FIG. 5, reference numeral 133 indicates the insert hole for letting the resin flow at the time of insertion. Further reference numeral 135 denotes a mark indicating the polarity, and reference numeral 137 is a projection indicating the direction.

In the present embodiment, the magnet 111 is mechanically supported between the base 106 and the four support portions 104 which serves as magnet support portions protrusively provided on the inner wall of the lower case 103. Consequently, in such a structure according to the third embodiment, the same effect as that of the case of the first or second embodiment is substantially obtained The present invention is not limited to the first through third embodiments as described above.

The magnet support portion may be provided continuously in the circumferential direction of the support member like the first or second embodiment, and also may be provided intermittently like the third embodiment. When the magnet support portions are provided intermittently, the number or each size of portions may be freely designated.

What is claimed is:

1. An electromagnetic type electroacoustic transducer, comprising;

a case;

a base located in said case;

a core projecting from said base;

a coil wound around said core;

a magnet having (1) a first axial end supported by said base such that said magnet extends around said coil, and (2) a second axial end;

a support member located around said magnet, for supporting an elastic plate; and a magnet support portion extending from said support member in an inward direction relative to said magnet, such that said magnet support portion abuts said second axial end to prevent an axial movement of said magnet away from said base.

2. The electromagnetic type electroacoustic transducer as claimed in claim 1, wherein said support member is a support ring placed on an inner peripheral side of said case, and said magnet support portion is a flange provided on an inner peripheral side of said support ring.

3. The electromagnetic type electroacoustic transducer as claimed in claim 1, wherein said support member is a wall of said case, and said magnet support portion is a flange extending from said wall of said case.

4. An electromagnetic type electroacoustic transducer comprising:

a case;

a base located in said case;

a core protrusively formed on said base;

a coil wound around said core;

a magnet placed around said coil; and a diaphragm superimposed over a top of said core with a predetermined clearance therebetween;

wherein a magnet support portion abuts a surface of said magnet opposing said diaphragm, such that said magnet support portion inhibits movement of said magnet in an axial direction of said magnet.

5. The electromagnetic type electroacoustic transducer as claimed in claim 4, wherein said magnet support portion is placed around said magnet and is provided on a support member which supports said diaphragm.

6. The electromagnetic type electroacoustic transducer as claimed in claim 5, wherein said support member is a support ring placed on an inner peripheral side of said case, and said magnet support portion is a flange provided on an inner peripheral side of said support ring.

7. The electromagnetic type electroacoustic transducer as claimed in claim 5, wherein said support member is a wall of said case, and said magnet support portion is a flange extending from said wall of said case.

8. The electromagnetic type electroacoustic transducer as claimed in claim 2, 3, 6, or 7, wherein said flange includes a surface that slants away from said elastic plate, such that a clearance between said surface and said elastic plate increases towards a center of said elastic plate.

9. The electromagnetic type electroacoustic transducer as claimed in claim 2, 3, 6, or 7, wherein said support member further comprises:

a step portion for supporting said elastic plate; and a clearance portion for separating said step portion from said flange.

10. The electromagnetic type electroacoustic transducer as claimed in claim 2, 3, 6, or 7, wherein said support member further comprises:

a step portion for supporting said elastic plate;

wherein said flange extends from said support member immediately adjacent said step portion.

11. The electromagnetic type electroacoustic transducer as claimed in claim 2, 3, 6, or 7, wherein said flange is provided continuously in a circumferential direction of said magnet.

12. The electromagnetic type electroacoustic transducer as claimed in claim 2, 3, 6, or 7, wherein said flange is provided intermittently in a circumferential direction of said magnet.

* * * * *